United States Patent [19]

Bazan

[11] Patent Number: 4,749,124

[45] Date of Patent: Jun. 7, 1988

[54] CARD

[76] Inventor: Edward Bazan, 5817 N. 25th St., McAllen, Tex. 78504

[21] Appl. No.: 822,825

[22] Filed: Jan. 27, 1986

[51] Int. Cl.[4] ..... B42D 15/00

[52] U.S. Cl. ..... 229/92.8

[58] Field of Search ..... 229/92.8, 92.1

[56] References Cited

U.S. PATENT DOCUMENTS 1,886,669 11/1932 Gillespie ..... 229/92.8

FOREIGN PATENT DOCUMENTS 1479422 5/1967 France ..... 229/92.8

*Primary Examiner*—Willis Little

*Attorney, Agent, or Firm*—Robert M. Carwell; Darryl M. Springs

[57] ABSTRACT

A card for conveying short messages and information in the nature of a postal card or the like. The card defines a front and back surface suitable for receiving printed material. A crease is formed in the card so as to define a flap rotatable about the crease. The flap carries a perforated tab having a sealing material thereon for sealing the flap permanently against the balance of the card so as to obscure the written message from view. The tab is perforated whereby in order to view the message the tab is separated along the perforations from the flap thereby exposing the message. Disposed about the peripheral edge of the flap are areas containing a second temporary sealing material which also may hold the flap in a folded position temporarily for marketing display purposes whereby the flap is non-destructively releasable from its temporarily sealed position.

2 Claims, 1 Drawing Sheet

CARD

FIELD OF THE INVENTION

This invention relates to cards adapted for conveying messages and information and, more particularly, relates to such cards particularly adapted for use as a postal card or the like in conveying messages through the postal service.

BACKGROUND OF THE INVENTION

Various means have long been available in the art for conveying written material or information in a compact form while at the same time offering privacy to the individuals communicating the messages as, for example, in the case of provision of various designs of envelopes and the like. Situations arise wherein it is desirable to provide for a card of very simple and inexpensive design as, for example, in the case of a picture postcard, which provides privacy of the message without the need for a separate envelope. Accordingly, various designs of postcards were effected for covering the message as in the case of the familiar accordion-like plurality of postcards which fold in on themselves. These cards generally include some form of seal rendering it difficult to read the messages or information contained therein.

Not only were such designs cumbersome and oftentimes expensive, but they did not suit the needs of some users for a simple and inexpensive way to convey short messages with a modicum of privacy. Moreover, with respect to the familiar multiple postcard designs, and other attempts to provide privacy without the need for a separate envelope, methods for sealing off the messages contained therein were generally unsatisfactory for a number of reasons. Some materials provided for slots with matingly receivable tabs whereby, after conveying the desired message on the card, the user folded the card up and inserted the slot into the tab. While this form of sealing provided for convenient releasability for altering the message or the like, such means for sealing was inherently unreliable, frequently coming open in the mail to expose the message contents and providing no visible indication of tampering. Yet other means for providing sealing, while maintaining the integrity of the seal better than the aforementioned tab-slot arrangement, were irreversible. Once the seal was effected, the only way in which the message contents of the card could be viewed by the user for revision or the like was to effect a destructive act on the seal by wedging a letter opener therebetween or the like.

For the foregoing and other reasons which are readily apparent, a form of card was long desired which could maximize the available message space while still maintaining a relatively small size for mailing purposes. Such a card was further desired which provided for privacy of the recorded message in a simple and inexpensive manner without the necessity for envelopes, a plurality of folding accordion-like cards or the like. Yet additionally, such cards adapted for use in conveying written messages or the like were highly desired which could provide for both destructive and non-destructive sealing as desired. In this manner, for marketing purposes and the like, the card could be provided with a non-destructive seal whereby the card could be tested by the purchaser prior to purchase to understand the manner of sealing whereby the privacy of the message contained therein is preserved, without doing damage to the card. The permanent destructive seal could furrther be provided for use after purchase when the card is to be posted.

These and other benefits of the present invention are provided and shown in the accompanying drawings.

SUMMARY OF THE INVENTION

A card for conveying short messages and information. In a preferred embodiment, the card is in the nature of a postal card intended for use in mailing through the postal service and having combined features of increased privacy and message space. A card having surfaces suitable for receiving printed material is formed defining a front and back surface and a predetermined width. A crease is formed in the card in a direction substantially perpendicular to the direction in which the width is measured thereby creating a flap which is rotatable about the crease. A perforated tab extends from the edge of the flap and carries on one side thereof a peel-off backing strip having disposed thereunder a strip of adhesive material on the tab. Upon removing the peel-off strip and folding the flap along the crease to a second sealed or closed position whereby the flap lies in a plane substantially parallel to the plane defined by the remaining portion of the card, the adhesive material on the tab contacts the surface of the card so as to maintain the card in a flat folded and permanently sealed position. Upon tearing the tab along the perforations, the flap is freed to unfold along the crease to the initial first open or unsealed position, with the tab remaining adhered to the card at the same location wherein it was originally affixed.

A message space is provided comprising a portion of the flap on the same side as the adhesive material of the tab and further comprising a portion of the remaining space of part of the card not included in the flap. In this manner, when the card is in a first or open position (wherein the flap is not folded over the crease and adhered to the card by means of the tab), substantially the entire portion of the message space is visible for affixing messages or other information thereto or for reading messages. However, when the flap is folded about the crease and adhered to the remainder of the card by means of the adhesive tab whereby the card is disposed in a second sealed or closed position, the message spaces provided by the card are opposed one another in parallel fashion and obscured from view, thus providing the aforesaid privacy feature for the message.

The relative width of the flap with respect to the total width of the card is preselected whereby when the flap is in the second position, a remaining portion of the card on the side carrying the message space remains visible for purpose of providing space for addresses, postage, and the like. On the outer periphery of the flap and on the same side of the card as the adhesive material of the tab, a plurality of areas bearing exposed releasable adhesive material are provided for releasably sealing the flap to the remainder of the card when in the second position for demonstration purposes, whereby the flap may be unfolded without destroying a portion of the card. This is distinguishable from the case wherein the adhesive material under the peel-off layer of the perforated tab is employed to fold the flap into the second position (wherein the tab must be separated from the flap in order to unfold the flap). This non-destructive releasable mechanism is provided for purposes of non-destructive demonstration of the privacy feature of the card.

DETAILED DESCRIPTION OF THE INVENTION

Figure 1:
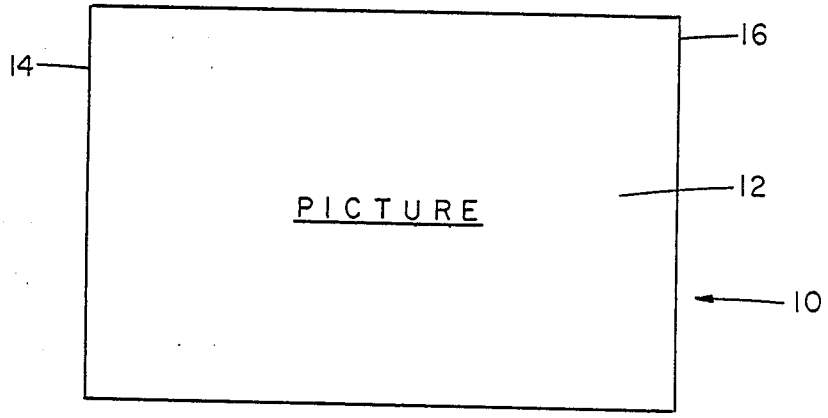
FIG. 1 is a pictorial illustration of a portion of one side of the card of the present invention.

Referring first to FIG. 1, there will be seen depicted therein generally a schematic view of a postal card 10 having a front surface 12 for purposes of carrying printed material thereon as desired such as, for example, a scenic picture in the case of picture postcards or the like. It will be appreciated that the invention disclosed herein is adaptable to any application wherein it is desired to simply and economically convey messages or other information wherein the privacy thereof is to be protected. Accordingly, in another embodiment of the invention, a picture on the front surface 12 may be dispensed of and the surface left blank or provided with other material as desired.

Still referring to FIG. 1, the card 10 will be seen to be of a generally rectangular configuration although the invention is not intended to be so limited and may take the form of a square or other geometrical shape as desired, the rectangular shape depicted therein being done primarily for purposes of indicating a conventional application to the familiar postcard. With respect to FIG. 1, the card 12 defines first and second edges 14 and 16, respectively, which are generally parallel to one another, the second edge 16 basically being defined by a crease which will become more clear with reference to FIG. 2.

Figure 2:
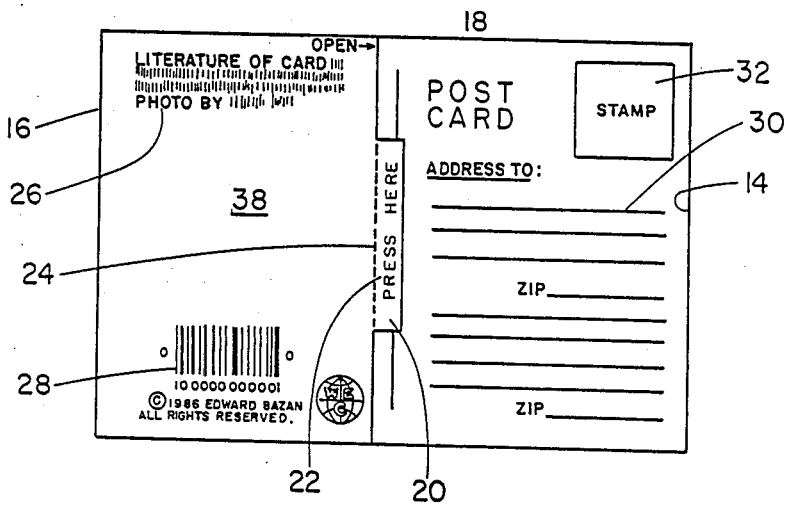
FIG. 2 is a pictorial illustration of the obverse side of the card depicted in FIG. 1, wherein the flap portion thereof is in a folded second position.

Referring now to FIG. 2, there is depicted therein a schematic indication of the obverse side of the postal card 10 when in a second folded position shown in FIG. 1. In this folded position, a flap portion 38 may be seen which forms a part of the card 10 and is integrally connected to the portion shown in FIG. 1 by means of the second edge 16 which forms a hinge-like connection between the flap 38 and the portion of the card 10 depicted in FIG. 1. Still referring to FIG. 2, the flap 38 is provided with a third edge 18 which in the embodiment shown therein is preferably substantially parallel to that of the second edge 16. Extending laterally from the third edge 18, a perforated tab 20 is provided intermediate the upper and lower ends of the third edge 18. This tab 20 preferably carries a printed instruction 22 thereon such as "press here" or the like for purposes which will become clearer hereinafter. Still further, the tab 20 is interconnected to the flap by means of an edge 24 which includes perforations provided for easily and reliably effecting the separation of the tab 20 from the flap 38 as desired when the card 10 is folded into the second folded position shown in FIGS. 1 and 2 after sealing the tab 20 to the card in a manner to be described.

Still referring to FIG. 2, on one side of the flap 38 a literature space 26 may be provided if desired in the case of postal cards for describing the scene or the like. Additionally, and also as desired, a coding and notice space 28 may further be provided for purposes of providing the uniform product code, copyright and/or trademark notices, or the like. Finally, with respect to FIG. 2, a suitable addressing space 30 and postage space 32 may be provided for purposes of affixing the address of the addressee and addressor as desired and for affixing the proper postage as required. It will be noted that when the flap 38 is in the second position shown in FIG. 2, whereby the card 10 defines the same general flat rectangular shape regarding the front side in FIG. 1 and the obverse side thereof in FIG. 2, the card appears much as would a conventional postcard well known in the art. In other words, a scenic picture may be shown on one side, and on the obverse side a description of the scene and space for writing on the flap 38 as well as the address and postage. However it will be noted that by comparing the card when in the second folded position of FIG. 2 with that of the card when in the opened or unfolded first position of FIG. 3, a relatively large message/information space 40 is provided which is not viewable when the card is in the second position of FIG. 2. In this manner, the previously described and highly desired privacy is provided the user.

Figure 3:
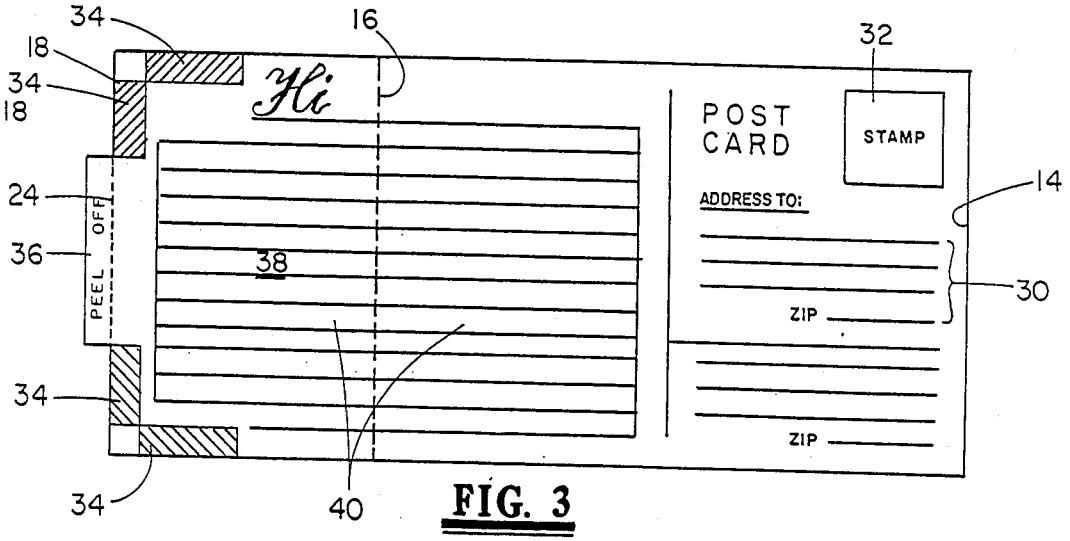
FIG. 3 is a pictorial illustration of the obverse side of the card of the present invention depicted in FIG. 1 when in the unfolded or opened first position exposing a portion of the card depicted in FIG. 2 as well as a portion hidden by the flap portion while.in the second position depicted in FIG. 2.

Referring now to FIG. 3, the postcard 10 will be seen illustrated therein when in the opened or unfolded first position 2. In this position, the flap 38 is rotated about the first creased edge 16 so that it may be positioned in a plane substantially identical to that defining the remaining portion of the card 10 depicted in FIG. 1. Disposed about the outer periphery of the flap 38, a plurality of temporary non-destructive releasable sealing areas 34 will preferably be provided. These areas will carry a releasable adhesive material such as that contained on the commercial available note pads such as the removable self-stick notes designated Note Pad 654 and sold by the Commercial Tape Division of the 3M Company, St. Paul, Minn. 55144, under the trademark "Post-It TM". It will be recalled that for marketing purposes, when cards such as the card 10 of the present invention are displayed for sale, it is desirable to be able to illustrate the privacy and sealing feature of the card while avoiding the necessity for a destructive seal. In this manner, the prospective purchaser may fold the card from the first to the second positions depicted in FIGS. 1-3, and see how the privacy sealing is effected as well as the wide space available for message writing without effecting any damage to the card upon unsealing the card. Thus, these areas carrying the releasable adhesive material are provided whereby when the flap 38 is folded into the position depicted in FIG. 2, the adhesive material of the areas 34 will contact opposing like areas of the card to releasably hold the flap 38 in the position shown in FIG. 2. However, a characteristic of the adhesive material such as that in the aforementioned commercially available note pads is that the adhesive material releases from the surface to which it is affixed without effecting any undue damage to the surface. Thus, the prospective purchaser may move the flap 38 of the present invention from the position depicted in FIG. 3 to that of FIG. 2 and vice-versa without fear of damaging the card.

Still referring to FIG. 3, on the side of the perforated tab 20 opposite the side depicted in FIG. 2, a peel-off backing strip 36 is provided having disposed thereunder an adhesive material with more permanent sticking ability than that of the adhesive material disposed within the areas 34. The backing strip 36 will preferably carry a printed message such as "peel off" or the like.

Now that a general structural description of the postal card of the present invention has been provided, the description of the operation thereof follows hereinafter. With the card 10 in the second or open position as shown in FIG. 3 wherein the flap 38 and remaining portions of the card 10 lie substantially in the same plane, the user may obviously place any message or communication as desired in the message/information space 40 defined by portions of the flap 38 and remaining portions of the card 10 as shown in FIG. 3. The user may further fold the flap 38 along the first edge or crease 16 so as to position it in the posture shown in FIG. 2, thereby demonstrating to his satisfaction the effect of the flap 38 in obscuring the material carried on the space 40. Moreover, by pressing around the periphery 38 when in the position shown in FIG. 2, the adhesive material in the areas 34 will compress against the opposing and mating areas of the card 10 so as to temporarily keep the flap 38 in the position shown in FIG. 2 while at the same time permitting easy and non-destructive release thereof, whereby the flap 38 may be repositioned in the position shown in FIG. 3. The card 10 may thus be stored for display purposes in the temporarily sealed position of FIG. 2.

However, when it is desired to permanently seal the information 40 for posting or other use wherein unauthorized persons are desirably inhibited from viewing the message, the user, following the printed instructions on the portion of the perforated tab 20 shown in FIG. 3 will peel off the backing strip 36 thereby exposing a permanent layer of adhesive carried on the tab 20. The flap 38 will thence be folded as before along the creased first edge 16 and disposed in the position shown in FIG. 2. Thence following the printed instructions now visible on the obverse side of the tab, as shown in FIG. 2, the user, by pressing on the tab, will effect a more permanent seal between the flap 38 and the remaining portions of the tab 10. When the card 10 is received by the end viewer who desires to read the message, the end user will separate the tab 20 from the remaining portions of the flap 38 by tearing the tab 20 along the perforations 24, and thence moving the remaining portion of the flap 38 from the position depicted in FIG. 2 to that of FIG. 3. In this manner, the message carried in space 40 is once again viewable as desired. Moreover, evidence of unauthorized tampering by breaking the seal will remain inasmuch as the tab 20 provides a destructive seal. In other words, upon breaking this second seal, the tab 20 remains sealedly affixed to the card 10 indicating that someone has opened the card.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and material composition of its components, as well as in the details of the illustrated construction, without departing from the scope and spirit thereof.

What is claimed is:

1. A postal card comprising:

a card portion defining a first and second edge;

a flap interconnected at one edge to said card portion at said first edge to define a crease and further defining a third edge; and a tab interconnected at said third edge;

said third edge having an upper and lower portion with said tab extending from said third edge intermediate said upper and lower portion;

an adhesvie coating on one side and a peelable covering disposed over said coating;

said card defining a plurality of perforations at a location wherein said tab extends from said third edge of said flap;

said flap being movable about said creased first edge whereby said card may be positioned in a first unfolded position defining a first flat area and a second folded position defining a second flat area smaller than said first flat area;

said flap defining a sealing area on the outer periphery of said flap carrying an adhesive means on the same side of said flap as said adhesive coating for demonstrating repeated temporary sealing, releasable disengagement, and resealing of said flap with said card portion.

2. The article of claim 1, wherein said adhesive coating on said tab is a permanent and substantially non-releasable coating whereby when said card is in said second position, and said peelable covering is removed from said tab to expose said adhesive coating, said coating contacts a mating portion of said card to maintain said flap in a plane substantially parallel to a plane defining said card portion.

* * * * *